US010854360B2

(12) United States Patent
Dressler et al.

(10) Patent No.: US 10,854,360 B2
(45) Date of Patent: Dec. 1, 2020

(54) POWER RESISTOR

(71) Applicant: VISHAY ELECTRONIC GMBH, Selb (DE)

(72) Inventors: Matthias Dressler, Selb (DE); Bertram Schott, Selb (DE)

(73) Assignee: VISHAY ELECTRONIC GMBH, Selb (DE)

( * ) Notice: Subject to any disclaimer, the term of this patent is extended or adjusted under 35 U.S.C. 154(b) by 0 days.

(21) Appl. No.: 16/624,093

(22) PCT Filed: Jun. 15, 2018

(86) PCT No.: PCT/EP2018/065963
§ 371 (c)(1),
(2) Date: Dec. 18, 2019

(87) PCT Pub. No.: WO2018/234181
PCT Pub. Date: Dec. 27, 2018

(65) Prior Publication Data

US 2020/0152360 A1 May 14, 2020

(30) Foreign Application Priority Data

Jun. 20, 2017 (DE) ..... 10 2017 113 600

(51) Int. Cl.
*H01C 1/02* (2006.01)

(52) U.S. Cl.
CPC ..... *H01C 1/02* (2013.01)

(58) Field of Classification Search
CPC . H01C 1/028; H01C 1/02; H01C 1/06; H01C 1/08; H01C 3/06
See application file for complete search history.

(56) References Cited

U.S. PATENT DOCUMENTS 4,716,396 A * 12/1987 Kneifel ..... H01C 1/012 338/226
2013/0120103 A1* 5/2013 Nazzaro ..... H01C 1/082 338/55

(Continued)

FOREIGN PATENT DOCUMENTS

DE 1439374 A1 3/1969
DE 10023272 C1 8/2001

(Continued)

OTHER PUBLICATIONS

JP 2014 093395, Sugimoto et al. (machine translation). (Year: 2014).*

(Continued)

*Primary Examiner* — Kyung S Lee
(74) *Attorney, Agent, or Firm* — Volpe Koenig

(57) ABSTRACT

A power resistor comprises a tubular housing composed of metal and a resistor element received therein, wherein the housing has four side walls that extend along a longitudinal axis of the housing between two ends and define a rectangular cross-section. The housing comprises four edges of the four side walls at at least one of the two ends. Two of the four side walls have a respective incision at their edges for introducing a fastening element and the two other side walls have a respective clearance in alignment with the oppositely disposed incision to facilitate a placement of a tool at a fastening element introduced into the respective incision.

13 Claims, 2 Drawing Sheets

(56) References Cited

U.S. PATENT DOCUMENTS

| | | | | |
|---|---|---|---|---|
| 2013/0154523 | A1* | 6/2013 | Brown | B60L 7/22 318/376 |
| 2013/0328660 | A1* | 12/2013 | Sshott | H01C 1/016 338/204 |
| 2019/0259513 | A1* | 8/2019 | Zhang | H01C 1/14 |

FOREIGN PATENT DOCUMENTS

| | | | |
|---|---|---|---|
| DE | 20308901 | U1 | 9/2003 |
| DE | 202008014586 | U1 | 1/2009 |
| EP | 1711035 | A1 | 10/2006 |
| EP | 2182529 | B1 | 4/2011 |
| JP | 2014093395 | A | 5/2014 |

OTHER PUBLICATIONS

Vishay Draloric, "Aluminum Housed Compact Wirewound Resistor," VACR datasheet (May 8, 2014).

* cited by examiner

Fig.1
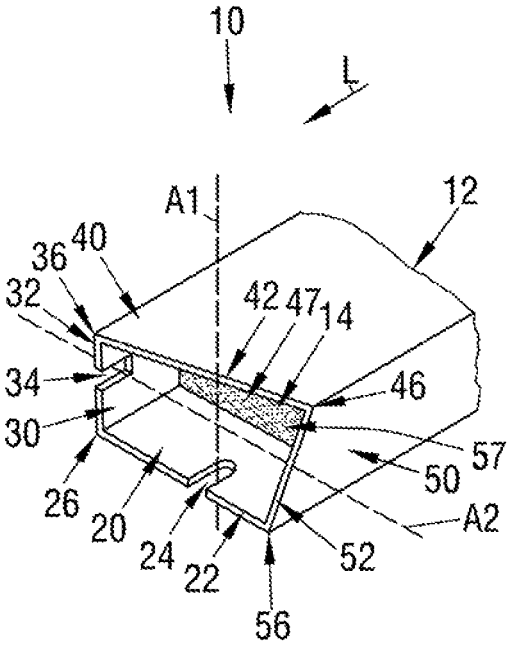
Fig.2
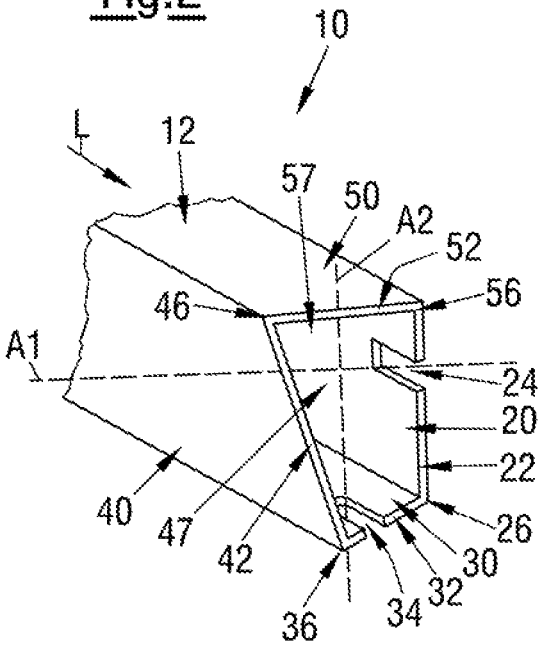
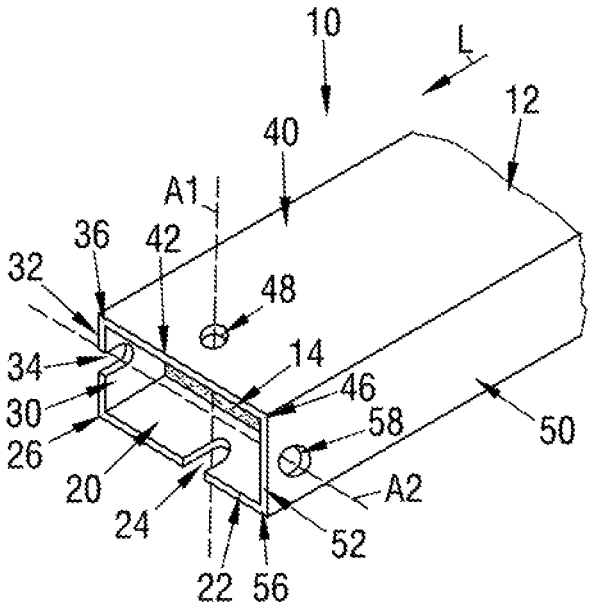
Fig.3
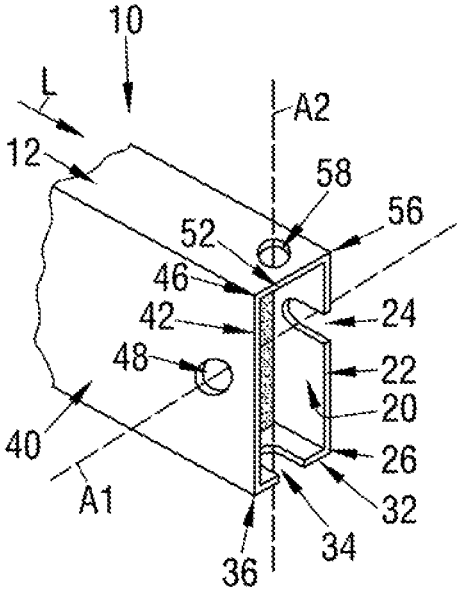
Fig.4

POWER RESISTOR

This application is a 371 application of International Application No. PCT/EP2018/065963, filed Jun. 15, 2018, which claims priority to German Patent Application No. 102017113000.2 filed. Jun. 20, 2017, the entire contents of which are hereby incorporated by reference as if fully set forth within.

The present invention relates to a power resistor comprising a tubular housing composed of metal and a resistor element received therein, wherein the housing has four side walls that extend along a longitudinal axis of the housing between two ends of the housing and define a rectangular cross-section of the housing, with a first and third side wall being disposed opposite one another and with a second and a fourth side wall being disposed opposite one another. The housing has an edge having an incision at at least one of the two ends for introducing a listening element.

Power resistors of the named kind have a broad range of applications. They are used, for example, as brake resistors in electrically operated railroad locomotives, but are also used in frequency inverters, drive controls, or in the field of renewable energies. Care must be taken here that the loss heat generated by a power resistor is led off fast and effectively.

Such power resistors therefore comprise a resistor element that can in particular be accommodated in a dust and water protected manner in a tubular housing and can be surrounded by a heat conductive insulation material that effects the required electrical insulation and nevertheless provides a fast transport of the loss heat to the surface of the housing. The surface of the housing should here be dimensioned sufficiently large to ensure a good heat transfer from the housing to a fastening environment and or to the environmental air. In another respect, the housing should be formed from a material having good heat conductivity so that the housing is, for example, produced from aluminum. The housing can be fastened at the respective end to a substrate by means of the incision at an edge of a side wall in that a fastening element—for example a screw—is introduced into the incision.

A power resistor of this kind is known from patent document DE 10023272 C1, with this document furthermore describing a manufacturing method to cut the tubular housing out of an elongate aluminum tube having, a rectangular cross-section without cutting loss and to thus manufacture power resistors that can be simply installed. However, the disadvantage results here that the kind and the direction of the cut of the aluminum tube predefine a single installation alignment of the power resistor.

It is therefore possible to selectively provide one of two different cutting directions for a housing having an elongate rectangular cross-section so that the housing can either be fastened in an alignment in which a longer edge of the elongate rectangular cross-sectional shape has an incision and lies on the substrate ("horizontal alignment") or can be fastened in an alignment in which a shorter edge of the elongate rectangular cross-sectional shape has an incision and lies on the substrate ("vertical alignment"). The side wall that is disposed opposite the side wall lying on the substrate is set back here due to the cutting offset to facilitate a placing of a tool at a fastening element that is introduced into the incision of the side wall lying on the substrate. There is, however, in turn a disadvantage in that the housing for the fastening in the horizontal alignment cannot be installed in the vertical alignment and vice versa, whereby the necessity arises of providing two different embodiment variants that can each be fastened only in one of the two aforesaid alignments.

It is therefore the underlying object of the invention to provide a power resistor of the initially described kind that can be fastened to a substrate in a simple manner both in the vertical alignment and in the horizontal alignment.

The object is satisfied by a power resistor having the features of claim 1 and in particular in that the housing comprises at at least one of the two ends—in particular at both ends: a first edge of the first side wall that has a first incision for introducing a fastening element; a second edge of the second side wall that has a second incision for introducing a fastening element; a third edge of the third side wall; and a fourth edge of the fourth side wall, wherein the third side wall has a first clearance at least substantially in alignment with the first incision and the fourth side wall has a second clearance at least substantially in alignment with the second incision to facilitate a placement of a tool at a fastening element introduced into the first incision or into the second incision.

The power resistor thus has two incisions at the edges of two mutually adjacent side walls of the housing that are called the first side wall and the second side wall for the purpose of a simpler reference in connection with the invention. The power resistor can be selectively installed in a first alignment in which the first side wall contacts the substrate or in a second alignment in which the second side wall contacts the substrate. The first alignment and the second alignment of the housing are thus offset by 90° with respect to one another and can in particular correspond to a vertical alignment and to a horizontal alignment of an elongate rectangular cross-section of the housing. The fastening of the power resistor to the substrate can here take place by means of a fastening element (e.g. a screw) that is introduced into the incision of the edge of the first side wall or into the incision of the edge of the second wall.

The third side wall of the housing disposed opposite the first side wall and the fourth side wall of the housing disposed opposite the second side wall have a respective clearance that is arranged at least substantially in alignment with the oppositely disposed incision. A sufficient clearance is hereby provided in the two selectable alignments of the housing to be able to place a tool (e.g. a screwdriver) at a fastening element introduced into the respective incision. The first clearance can in particular be provided in alignment with the first incision with respect to an axis extending perpendicular to the first side wall and in a corresponding manner the second clearance can in particular be provided in alignment with the second incision with respect to an axis extending perpendicular to the second side wall.

Where it is stated in connection with the invention that the respective clearance should be arranged "at least substantially" in alignment with the associated incision, this means that the clearance does not have to completely correspond to the outline, the size and/or the position of the associated incision; a certain difference, that nevertheless still enables an effective placement of a tool at a fastening element introduced into the respective incision, is also covered by this wording. It is in particular typically sufficient for the clearance and the incision to only overlap (viewed in projection). The incision, as will still be explained in the following, can, for example have an elongate form while this does not necessarily have to be the case for the associated clearance.

When considered geometrically, the power resistor can be configured such that an axis extending perpendicular to the plane of extent of the first side wall through the first incision does not intersect the housing and in particular not the (oppositely disposed) third side wall and such that an axis extending perpendicular to the plane of extent of the second side wall through the second incision does not intersect the housing and in particular not the (oppositely disposed) fourth side wall.

This arrangement is preferably provided at the two ends of the housing.

A fastening element can be selectively introduced into the first incision or into the second incision by the simultaneous formation of a first clearance and of a second clearance and can be engaged and actuated by a tool in a straight-line direction to fasten the power resistor to a substrate. The power resistor can thus advantageously be fastened in one of two selectable alignments, namely in said first alignment in which a longer edge lies on the substrate, for example, and in said second alignment in which a shorter edge lies on the substrate, for example. The necessity of providing two different embodiment variants of the power resistor that can each be fastened in only one of the two aforesaid alignments is thus dispensed with.

Advantageous embodiments of the invention can be seen from the dependent claims, from the description and front the drawing.

In accordance with a first embodiment, the third edge (that is the edge of the third side wall) is completely or sectionally set back relative to the first edge (that is the edge of the first side wall) along the longitudinal axis of the housing to form the first clearance and the fourth edge (that is the edge of the fourth side wall) is completely or sectionally set back relative to the second edge (that is the edge of the second side wall) along the longitudinal axis of the housing to form the second clearance. This means that the respective (third or fourth) edge or the respective edge section is offset relative to said other edge (first or second edge) along the longitudinal axis of the housing in the direction of the center of the power resistor. The first incision or the second incision is therefore freely accessible viewed in alignment due to this offset for the fastening of the power resistor to the substrate, whereby a fastening element cannot only be easily introduced, but can also be gripped by a tool with sufficient free space to be able to fasten the power resistor in a manner that can be handled easily. Such a set back arrangement of the third and fourth edges of the respective third and fourth side walls of the housing at the respective end of the housing can be simply manufactured, for example, by a corresponding selection of the cutting plane on the cutting to size of the housing from a rectangular tube.

In this embodiment, the first edge and the second edge advantageously extend within an orthogonal plane to the longitudinal axis of the housing. An advantageous reference line hereby results for the alignment of the power resistor at the substrate or relative to the fastening environment. The third edge can, however, extend at a slant with respect to (i.e. can be inclined to) said orthogonal plane to form the first clearance and the fourth edge can also extend at a slant with respect to said orthogonal plane to form the second clearance. Only the respective cutting plane has to be correspondingly selected on the cutting to size of the housing from a rectangular tube for the manufacture of the housing with the respective third and fourth edges extending at a slant. A certain cutting loss is admittedly hereby caused (with respect to the manufacture of a plurality of similar housings from the same rectangular tube). A simple manufacture of the housing is nevertheless possible in favor of the explained flexible alignment of the power resistor since only different cuts are required without a change of tool.

It is preferred in this embodiment if the third edge and the fourth edge at the respective end of the housing extend within a common cutting plane that extends at a slant to said orthogonal plane. The cutting to size of the housing at the respective end can hereby take place by only two cuts, with the one cut taking place through the rectangular tube along an orthogonal plane to the longitudinal axis of the rectangular tube and the other cut taking place along a plane extending at a slant hereto. The housing can thus be manufactured particularly fast, simply and inexpensively.

Alternatively to this, in accordance with a second embodiment, the third side wall of the housing can have an opening to form said first clearance and the fourth side wall of the housing can likewise have an opening to form said second clearance. An opening in this context is to be understood as a peripherally closed passage. The first clearance and the second clearance are therefore formed in this embodiment in that the third side wall and the fourth side wall have openings in alignment with the respective incision of the first edge or of the second edge. The openings can, for example, be circular and can in particular be formed by a bore, whereby a simple and inexpensive manufacture results. To facilitate the fastening of the power resistor and in particular the guiding of a tool through the opening, the respective opening should have a diameter that is larger than the width of the associated (i.e. oppositely disposed) incision.

In this embodiment, provision can in particular be made that the first edge, the second edge, the third edge, and the fourth edge extend within a common orthogonal plane to the longitudinal axis of the housing. The housing of the power resistor can thereby be manufactured particularly simply and in particular without any cutting loss.

As regards the respective incision of the first edge and of the second edge at the respective end of the housing, it is preferred for all of the aforesaid embodiments if the first incision and the second incision are elongate and extend along the longitudinal axis of the housing. The respective incision thus forms an indentation of the respective edge extending in the longitudinal direction of the housing. To facilitate an introduction of the fastening element along the longitudinal axis of the housing, the incision can have a constant width over its length. The incision is open at the respective edge and can be angled or round (e.g. semicircular) at its opposite end, it is, for example, possible by the respective incision first to align the fastening element at a provided position and to provisionally fix it in the substrate and only then to push the power resistor to the provided position to ultimately finally fix the power resistor there by the fastening element.

The respective incision can generally be arranged centrally at the respective (first or second) side wall of the housing. Provision is made in accordance with an advantageous embodiment, however, that the first incision is arranged off center at the first side wall and/or that the second incision is arranged off center at the second side wall. It can hereby be achieved that connector elements of the resistor element that typically project centrally from the housing do not stand in the way of a tool at a fastening element introduced into the incision. In accordance with such an off center arrangement of the incisions, the respective (first or second) clearance can also be arranged at the respective (third or fourth) side wall.

To be able to simply integrate the resistor element into an electric circuit, the resistor element advantageously has connector elements that project out of the housing.

In accordance with an embodiment, the resistor element is held in an electrically insulating carrier body within the housing. For this purpose, the material that forms the carrier body and that surrounds the resistor element is electrically insulating, whereby an electrical contact is prevented between the resistor element and the electrically conductive housing. The cross-section of the housing can be completely filled by the carrier body surrounding the resistor element. The housing can be closed in an airtight manner at the front sides to protect the resistor element from moisture or dust.

The invention will be described in the following purely by way of example with, reference to the drawings. Elements which are the same or of the same kind are marked by the same reference numerals therein.

FIG. 1 shows a perspective view of a first embodiment of a power resistor in accordance with the invention in a horizontal alignment;

FIG. 2 shows a perspective view of a first embodiment of a power resistor in accordance with the invention in a vertical alignment, FIG. 3 shows a perspective view of a second embodiment of a power resistor in accordance with the invention in a horizontal alignment;

FIG. 4 shows a perspective view of a second embodiment of a power resistor in accordance with the invention in a vertical alignment.

Figures 5, 5A, 5B:
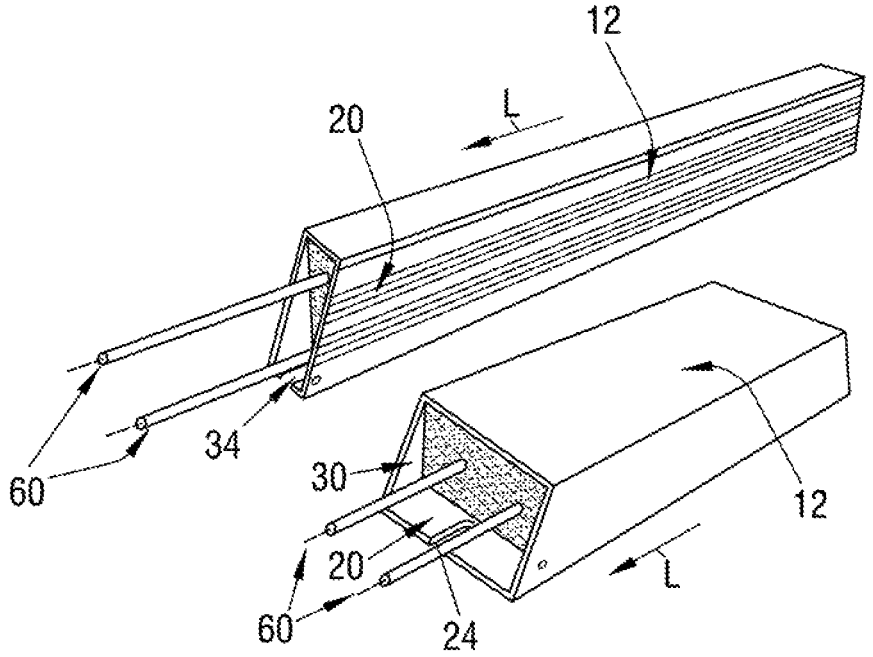
FIG. 5 shows a perspective view of a power resistor of a known construction in a vertical (FIG. 5*a*) and a horizontal (FIG. 5*b*) alignment.

A first embodiment of a power resistor 10 in accordance with the invention is shown in FIG. 1 and in FIG. 2, wherein the power resistor 10 is shown in a horizontal alignment in FIG. 1 and in a vertical alignment in FIG. 2. The power resistor 10 comprises a tubular housing 12 of aluminum in whose interior a resistor element, not shown, is arranged. The housing 12 extends along a longitudinal axis L.

The resistor element in the interior of the housing 12 extends strand-like along the longitudinal axis L and can, for example, be configured as a glass fiber cord that is wound around by resistor wire. The resistor element is surrounded by a carrier body of heat conductive insulation material (not shown) for the electrical insulation and dissipation of the resistor element. The housing 12 is closed by termination walls 14 at the axial front sides.

Core end sleeves, not shown, that serve for the connection of connector cables that project from the housing 12 at both ends of the housing 12 (cf. the connector cables 60 shown in FIG. 5) can be attached to both ends of the resistor element. The termination walls 14 have leadthroughs, not shown, for this purpose.

The housing 12 has four side walls that define an elongate rectangular cross-section, with a first side wall 20 and a third side wall 40 being disposed opposite one another and with a second side wall 30 and a fourth side wall 50 being disposed opposite one another. The side walls form straight-line edges at their ends shown in FIG. 1 and FIG. 2, with a first edge 22 terminating the first side wall 20, a second edge 32 terminating the second side all 30, a third edge 42 terminating the third side wall 40, and a fourth edge 52 terminating the fourth side wall 50.

The four edges each converge on one another pairwise at four corner points, with a first corner point 26 being formed by the convergence of the first edge 22 with the second edge 32, a second corner point 36 being formed by the convergence of the second edge 32 with the third edge 42, a third corner point 46 being formed by the convergence of the third edge 42 with the fourth edge 52, and a fourth corner point 56 being formed by the convergence of the fourth edge 52 with the first edge 22.

The first edge 22 of the first side wall 20 has a first incision 24 for introducing a fastening element—for example a screw—that extends along the longitudinal axis L of the housing 12 and that hereby interrupts the first edge 22. The second edge 32 of the second side wall 30 equally has a second incision 34 for introducing a fastening element that extends along the longitudinal axis L of the housing 12 and that hereby interrupts the second edge 32. The incisions 24 and 34 are open toward their respective edges 22 and 32 and can be round or angled at their oppositely disposed ends, with combined forms such as shown in FIG. 1 and FIG. 2 also being possible.

The incisions 24 and 34 can be formed by milling, for example. The incisions 24 and 34 can be arranged centrally or offset from the center with respect to the corresponding edge 22 and 32 respectively. A plurality of incisions (attached centrally or offset from the center) can in particular also be provided at the respective edge 22 and 32. Different possibilities for positioning the fastening element would thus result in dependence on the demands of the spatial arrangement of the power resistor.

The power resistor 10 can first be brought into the provided position of a substrate for fastening to the substrate and can then be fixed by the fastening element introduced into one of the incisions 24 or 34. It is alternatively also possible first to align the fastening element in a first step and to lightly fix it in the substrate at a provided position. In a second step, the power resistor 10 can be pushed through the opening of one of the incisions 24 or 34 applied to the respective edge 22 or 32 to the fastening element at the provided position at the substrate to fix it there by the fastening element.

To provide sufficient free space for the required placement of a tool at a fastening element introduced into the first incision 24 or into the second incision 34 for such a fastening of the power resistor 10, the third side wall 40 has a first clearance 47 and the fourth side wall 50 has a second clearance 57. The first clearance 47 is here provided along an axis A1 that extends perpendicular to the plane of extent of the first side wall 20 in alignment with the first incision 24. The second clearance 57 is accordingly provided in alignment with the second incision 34 along an axis A2 that extends perpendicular to the plane of extent of the second side wall 30. The first clearance 47 is here formed in that the third edge 42 extends at a slant with respect to an orthogonal plane to the longitudinal axis L of the housing 12 and is hereby increasingly set back along the longitudinal axis L of the housing 12 relative to the first edge 22 starting from the second corner point 36. The second clearance 57 is formed in that the fourth edge 52 likewise extends at a slant with respect to said orthogonal plane to the longitudinal axis L of the housing 12 and is hereby increasingly set back along the longitudinal axis L of the housing 12 relative to the second edge 32 starting from the fourth corner point 56.

This embodiment can be manufactured in a simple manner by applying only two cuts to a rectangular tube, with a fast cut cutting the rectangular tube along a first cutting plane that corresponds to said orthogonal plane to the longitudinal axis L of the housing 12 so that the first edge 22 and the second edge 32 are defined and formed. The first clearance 47 and the second clearance 57 are formed by a second cut that starts at the second corner point 36 and at the fourth corner point 56 of the housing 12 and takes place along a cutting plane that extends at a slant to said orthogonal plane and set back in the direction of extent of the housing 12. The second cutting plane forms the third edge 42 and the fourth edge 52 respectively by its cut with the third side wall 40 or the fourth side wall 50 respectively, said third and fourth edges forming the first clearance 47 and the second clearance 57 respectively by their slanted extent and by the corresponding setting back relative to the first edge 22 or to the second edge 32 respectively.

As a result, the cutting procedure forms four edges 22, 32, 42, and 52 of the housing 12 with little cutting loss, with a respective two edges 22 and 32 and 42 and 52 respectively extending in common planes that include an angle with one another. The first incision 24 and the second incision 34 can be reached without obstruction for a straight-line access from the respective oppositely disposed side wall 40 or 50 respectively due to a tilt of the two planes with respect to one another and due to the first and second clearances 47, 57 thus formed. Possible accesses for placing a tool to a fastening element introduced into the first incision 24 or into the second incision 34 are indicated by the axes A1 and A2 shown by dashed lines in FIG. 1 and FIG. 2.

The power resistor 10 can now selectively be fastened to a substrate in a horizontal alignment on an introduction of the fastening element into the first incision 24 or in a vertical alignment on an introduction of the fastening element into the second incision 34 with the free access to the first incision 24 and to the second incision 34.

In contrast, with power resistors of a known configuration, such as FIG. 5 shows, two different embodiments are provided that can only be installed in one respective alignment—vertical or horizontal. This is due to a cutting process that enables the formation of only one clearance with respect to a first incision 34—for a horizontal alignment—or with respect to a second incision 34—for a vertical alignment. The manufacturing process for a housing 12 of known power resistors in accordance with FIG. 5 is based on only one slanted cut, wherein in the embodiment in accordance with FIG. 5*a*, the long edges of the elongate rectangular cross-section of the housing 12 extend at a slant to an orthogonal plane with respect to the longitudinal axis L of the housing 12 and, in the embodiment in accordance with FIG. 5*b*, the short edges of the elongate rectangular cross-section of the housing 12 extend at a slant to an orthogonal plane with respect to the longitudinal axis L of the housing 12. The housings 12 can be manufactured for power resistors of a known configuration without cutting loss due to the restriction of the cutting process to one single cut. In turn, however, these power resistors have restrictions in functionality, in particular with respect to the fastening to the deployment site.

A second embodiment of a power resistor 10 in accordance with the invention is shown in FIG. 3 and in FIG. 4, wherein the power resistor 10 is shown in a horizontal alignment in FIG. 3 and in a vertical alignment in FIG. 4. The power resistor 10 of the second embodiment only differs from the power resistor 10 of the first embodiment by the shape of the clearances so that reference is made to the above explanations for a description of the inner design.

As can be seen from FIG. 3 and FIG. 4, the four edges 22, 32, 42, and 52 of the housing body 12 extend in a common plane that corresponds to an orthogonal plane of the housing 12 with respect to its longitudinal axis L. The formation of the edges 22, 32, 42, and 52 here takes place by a single cut perpendicular to the side walls 20, 30, 40, and 50 of the rectangular tube.

In the second embodiment, the first clearance and the second clearance are formed in that the third side wall 40 and the fourth side wall 50 have openings 48 and 58 respectively through which a tool can be led to fix a fastening element introduced into the first incision 24 or into the second incision 34. A first opening 48 is arranged in the third side wall 40 for this purpose such that it is disposed opposite the incision 24 in the first side wall 20. A second opening 58 is equally disposed in the fourth side wall 50 opposite the incision 34 in the second side wall 30. If a plurality of incisions are provided (centrally or offset from the center of an edge) per side wall, a plurality of openings or a sufficiently large opening are/is accordingly formed that are/is disposed opposite the respective incisions.

The openings 48 and 58 can, for example, be circular and can in particular be formed by a bore, whereby a simple and inexpensive manufacture results. To facilitate the fastening of the power resistor and in particular the guidance of a tool through the openings 48 and 58 respectively, the openings 48 and 58 should here have a diameter that is larger than the width of the respective incision 24 and 34 (viewed transversely to the longitudinal axis L). The housing 12 of the second embodiment can thus be manufactured without cutting loss like the housing 12 of the previous power resistors (see FIG. 5). The manufacture, however, requires a tool change for this purpose to apply the openings 48 and 58 in the side walls 40 and 50.

The openings 48 and 58 prevent an obstruction of the first incision 24 and of the second incision 34 by the respective oppositely disposed side wall 40 and 50 respectively and enable the simultaneous straight-line access to both incisions 24, 34. Possible accesses for a straight-line placement of a tool to a fastening element introduced into the first incision 24 or into the second incision 34 are indicated by the axes A1 and A2 shown by dashed lines in FIG. 3 and FIG. 4.

The power resistor 10 can now selectively be fastened in a simple manner in the horizontal alignment on an introduction of the fastening element into the first incision 24 or in the vertical alignment on an introduction of the fastening element into the second incision 34.

It is understood that the embodiment of a longitudinal end of the housing 12 explained with reference to FIGS. 1 to 4 can analogously also be provided at the other longitudinal end of the housing 12, with the respective incision 24, 34 being provided at the same side wall 20 or 30.

REFERENCE NUMERAL LIST

10 power resistor
12 housing
14 termination wall
20 first side wall
22 first edge
24 first incision
26 first corner point
30 second side wall
32 second edge
34 second incision
36 second corner point
40 third side wall
42 third edge
46 third corner point
47 first clearance
48 first opening
50 fourth side wall
52 fourth edge
56 fourth corner point

57 second clearance
58 second opening
60 connector cable
A1 axis through 24
A2 axis through 34
L longitudinal axis

The invention claimed is:

1. A power resistor comprising a housing that is tubular, the housing composed of metal and having a resistor element received therein, wherein the housing has four side walls that extend along a longitudinal axis of the housing between two ends and that define a rectangular cross-section, with a first side wall and a third side wall being disposed opposite one another and with a second side wall and a fourth side wall being disposed opposite one another, wherein the housing comprises at least one of the two ends, the at least one of the two ends comprising:

a first edge of the first side wall that has a first incision for introducing a fastening element, a second edge of the second side wall that has a second incision for introducing a fastening element, a third edge of the third side wall, and a fourth edge of the fourth side wall;

the third side wall having a first clearance at least substantially in alignment with the first incision and the fourth side wall having a second clearance at least substantially in alignment with the second incision to facilitate a placement of a tool at a fastening element introduced into at least one of the first incision or the second incision;

wherein the first edge and the second edge extend within an orthogonal plane to the longitudinal axis of the housing; wherein the third edge extends at a slant with respect to said orthogonal plane to form the first clearance; and wherein the fourth edge extends at a slant with respect to said orthogonal plane to form the second clearance.

2. The power resistor in accordance with claim 1, wherein the third edge is at least sectionally set back relative to the first edge along the longitudinal axis of the housing to form the first clearance; and wherein the fourth edge is at least sectionally set back relative to the second edge along the longitudinal axis of the housing to form the second clearance.

3. The power resistor in accordance with claim 1, wherein the third edge and the fourth edge extend within a common cutting plane that extends at a slant to said orthogonal plane.

4. The power resistor in accordance with claim 1, wherein the first incision and the second incision are formed as elongate and extend along the longitudinal axis of the housing.

5. The power resistor in accordance with claim 4, wherein at least one of the first incision is arranged off center at the first side wall and the second incision is arranged off center at the second side wall.

6. The power resistor in accordance with claim 1, wherein the resistor element has connector elements that project from the housing.

7. The power resistor in accordance with claim 1, wherein the resistor element is held in an electrically insulating carrier body within the housing.

8. The A power resistor in accordance with claim 1, wherein the housing is formed from aluminum.

9. A power resistor comprising a housing that is tubular, the housing composed of metal and having a resistor element received therein, wherein the housing has four side walls that extend along a longitudinal axis of the housing between two ends and that define a rectangular cross-section, with a first side wall and a third side wall being disposed opposite one another and with a second side wall and a fourth side wall being disposed opposite one another, wherein the housing comprises at least one of the two ends, the at least one of the two ends comprising:

a first edge of the first side wall that has a first incision for introducing a fastening element, a second edge of the second side wall that has a second incision for introducing a fastening element, a third edge of the third side wall, and a fourth edge of the fourth side wall;

the third side wall having a first clearance at least substantially in alignment with the first incision and the fourth side wall having a second clearance at least substantially in alignment with the second incision to facilitate a placement of a tool at a fastening element introduced into at least one of the first incision or the second incision;

wherein the third side wall has an opening to form the first clearance and wherein the fourth side wall has an opening to form the second clearance, and wherein the first edge, the second edge, the third edge, and the fourth edge extend within a common orthogonal plane to the longitudinal axis of the housing.

10. The power resistor in accordance with claim 9, wherein the opening of the third side wall is formed by a peripherally closed passage, and wherein the opening of the fourth side wall is formed by a peripherally closed passage.

11. A power resistor comprising a housing that is tubular, the housing composed of metal and having a resistor element received therein, wherein the housing has four side walls that extend along a longitudinal axis of the housing between two ends and that define a rectangular cross-section, with a first side wall and a third side wall being disposed opposite one another and with a second side wall and a fourth side wall being disposed opposite one another, wherein the housing comprises at least one of the two ends, the at least one of the two ends comprising:

a first edge of the first side wall that has a first incision for introducing a fastening element, a second edge of the second side wall that has a second incision for introducing a fastening element, a third edge of the third side wall, and a fourth edge of the fourth side wall;

the third side wall having a first clearance at least substantially in alignment with the first incision and the fourth side wall having a second clearance at least substantially in alignment with the second incision to facilitate a placement of a tool at a fastening element introduced into at least one of the first incision or the second incision;

wherein the third side wall has an opening to form the first clearance and wherein the fourth side wall has an opening to form the second clearance, wherein the opening of the third side wall is formed by a peripherally closed passage and wherein the opening of the fourth side wall is formed by a peripherally closed passage.

12. A power resistor comprising a housing that is tubular, the housing composed of metal and having a resistor element received therein, wherein the housing has four side walls that extend along a longitudinal axis of the housing between two ends and that define a rectangular cross-section, with a first side wall and a third side wall being disposed opposite one another and with a second side wall and a fourth side wall being disposed opposite one another, wherein the housing comprises at least one of the two ends, the at least one of the two ends comprising:

a first edge of the first side wall that has a first incision for introducing a fastening element, a second edge of the second side wall that has a second incision for introducing a fastening element, a third edge of the third side wall, and a fourth edge of the fourth side wall;

the third side wall having a first clearance at least substantially in alignment with the first incision and the fourth side wall having a second clearance at least substantially in alignment with the second incision to facilitate a placement of a tool at a fastening element introduced into at least one of the first incision or the second incision;

wherein the first clearance comprises a slanted portion of the third wall opposite the first incision, and wherein the second clearance comprises a slanted portion of the fourth wall opposite the second incision.

13. A power resistor comprising a housing that is tubular, the housing composed of metal and having a resistor element received therein, wherein the housing has four side walls that extend along a longitudinal axis of the housing between two ends and that define a rectangular cross-section, with a first side wall and a third side wall being disposed opposite one another and with a second side wall and a fourth side wall being disposed opposite one another, wherein the housing comprises at least one of the two ends, the at least one of the two ends comprising:

a first edge of the first side wall that has a first incision for introducing a fastening element, a second edge of the second side wall that has a second incision for introducing a fastening element, a third edge of the third side wall, and a fourth edge of the fourth side wall;

the third side wall having a first clearance at least substantially in alignment with the first incision and the fourth side wall having a second clearance at least substantially in alignment with the second incision to facilitate a placement of a tool at a fastening element introduced into one of the first incision and the second incision;

wherein the first clearance comprises a hole in the third wall opposite the first incision, and wherein the second clearance comprises a hole in the fourth wall opposite the second incision.

* * * * *